US012258894B2

(12) United States Patent
Saruwatari et al.

(10) Patent No.: US 12,258,894 B2
(45) Date of Patent: Mar. 25, 2025

(54) MARINE PROPULSION DEVICE AND MARINE VESSEL

(71) Applicant: YAMAHA HATSUDOKI KABUSHIKI KAISHA, Iwata (JP)

(72) Inventors: Kimitaka Saruwatari, Shizuoka (JP); Kenji Yukishima, Shizuoka (JP); Yu Wakamizu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 532 days.

(21) Appl. No.: 17/855,836

(22) Filed: Jul. 1, 2022

(65) Prior Publication Data

US 2023/0009087 A1 Jan. 12, 2023

(30) Foreign Application Priority Data

Jul. 12, 2021 (JP) ..... 2021-115190

(51) Int. Cl.

| | |
|---|---|
| ***F01N 3/04*** | (2006.01) |
| ***B63H 20/24*** | (2006.01) |
| ***B63H 20/28*** | (2006.01) |

(52) U.S. Cl.

CPC ..... *F01N 3/043* (2013.01); *B63H 20/245* (2013.01); *B63H 20/285* (2013.01)

(58) Field of Classification Search

CPC ..... F01N 3/043; B63H 20/245; B63H 20/285

See application file for complete search history.

(56) References Cited

U.S. PATENT DOCUMENTS

| | | | | |
|---|---|---|---|---|
| 2002/0166518 | A1* | 11/2002 | Osakabe | F02B 75/22 123/41.31 |
| 2004/0116009 | A1 | 6/2004 | Tawa et al. | |
| 2004/0198110 | A1 | 10/2004 | Sumigawa et al. | |
| 2010/0056001 | A1 | 3/2010 | Konakawa et al. | |

FOREIGN PATENT DOCUMENTS

| | | | |
|---|---|---|---|
| JP | H0235129 | B2 * | 8/1990 |
| JP | 9-41967 | A | 2/1997 |
| JP | 2000-337141 | A | 12/2000 |
| JP | 2004-132308 | A | 4/2004 |
| JP | 2004-306722 | A | 11/2004 |
| JP | 2006-21714 | A | 1/2006 |
| JP | 2010-53771 | A | 3/2010 |
| JP | 2012-246881 | A | 12/2012 |

* cited by examiner

*Primary Examiner* — Stephen P Avila

(74) *Attorney, Agent, or Firm* — Keating & Bennett, LLP

(57) ABSTRACT

A marine propulsion device includes an engine, an exhaust pipe to allow exhaust gas of the engine to pass through the exhaust pipe, and a cooling water supply passage to supply cooling water for the engine into the exhaust pipe toward a downstream side in a flow direction of the exhaust gas and cause the cooling water to flow circumferentially along an inner peripheral surface of the exhaust pipe.

20 Claims, 5 Drawing Sheets

MARINE PROPULSION DEVICE AND MARINE VESSEL

CROSS REFERENCE TO RELATED APPLICATIONS

This application claims the benefit of priority to Japanese Patent Application No. 2021-115190 filed on Jul. 12, 2021. The entire contents of this application are hereby incorporated herein by reference.

BACKGROUND OF THE INVENTION

1. Field of the Invention

The present invention relates to a marine propulsion device and a marine vessel each including a cooling water supply passage to supply cooling water into an exhaust pipe.

2. Description of the Related Art

A marine propulsion device including a cooling water supply passage to supply cooling water into an exhaust pipe is known in general. Such a marine propulsion device is disclosed in Japanese Patent Laid-Open No. 2000-337141, for example.

Japanese Patent Laid-Open No. 2000-337141 discloses an outboard motor including an exhaust passage and a cooling water supply passage to supply cooling water into the exhaust passage. The cooling water supply passage supplies cooling water toward the downstream side in the flow direction of exhaust gas in the exhaust passage.

However, in the outboard motor described in Japanese Patent Laid-Open No. 2000-337141, the cooling water supplied from the cooling water supply passage obstructs the flow of the exhaust gas in the exhaust passage, and thus a pressure loss is increased. Furthermore, it is difficult to evenly cool a pipe defining the exhaust passage simply by supplying the cooling water toward the downstream side in the flow direction of the exhaust gas in the exhaust passage. Therefore, it has been conventionally desired to decrease a pressure loss with respect to the flow of exhaust gas in an exhaust passage occurring when cooling water is supplied into the exhaust passage and evenly cool an exhaust pipe with the cooling water.

SUMMARY OF THE INVENTION

Preferred embodiments of the present invention provide marine propulsion devices and marine vessels that each decrease pressure losses with respect to the flow of exhaust gas in exhaust pipes occurring when cooling water is supplied into the exhaust pipes and evenly cool the exhaust pipes with the cooling water.

A marine propulsion device according to a preferred embodiment of the present invention includes an engine, an exhaust pipe to allow exhaust gas of the engine to pass through the exhaust pipe, and a cooling water supply passage to supply cooling water for the engine into the exhaust pipe toward a downstream side in a flow direction of the exhaust gas and cause the cooling water to flow circumferentially along an inner peripheral surface of the exhaust pipe.

A marine propulsion device according to a preferred embodiment of the present invention includes the cooling water supply passage to supply the cooling water into the exhaust pipe toward the downstream side in the flow direction of the exhaust gas and cause the cooling water to flow circumferentially along the inner peripheral surface of the exhaust pipe. Accordingly, the cooling water flows along the inner peripheral surface of the exhaust pipe away from a central portion of the exhaust pipe, and thus obstruction of the main flow of the exhaust gas passing through the central portion of the exhaust pipe by the cooling water is significantly reduced or prevented. Therefore, a pressure loss with respect to the flow of the exhaust gas in the exhaust pipe occurring when the cooling water is supplied into the exhaust pipe is decreased. Furthermore, the cooling water flows circumferentially along the inner peripheral surface of the exhaust pipe such that as compared with a case in which the cooling water is supplied linearly toward the downstream side in the flow direction of the exhaust gas, the cooling water contacts a larger area of the inner peripheral surface of the exhaust pipe. Therefore, the exhaust pipe is evenly cooled by the cooling water. Thus, a pressure loss with respect to the flow of the exhaust gas in the exhaust pipe occurring when the cooling water is supplied into the exhaust pipe is decreased, and the exhaust pipe is evenly cooled by the cooling water.

In a marine propulsion device according to a preferred embodiment of the present invention, the cooling water supply passage preferably causes the cooling water to flow helically in the exhaust pipe by causing the cooling water to flow circumferentially along the inner peripheral surface of the exhaust pipe. Accordingly, the cooling water flows helically in the exhaust pipe, and thus the cooling water flows farther along the inner peripheral surface of the exhaust pipe. Consequently, a pressure loss with respect to the flow of the exhaust gas in the exhaust pipe occurring when the cooling water is supplied into the exhaust pipe is further decreased, and the exhaust pipe is cooled more evenly by the helically flowing cooling water.

In a marine propulsion device according to a preferred embodiment of the present invention, the inner peripheral surface of the exhaust pipe is preferably circular or substantially circular, and the cooling water supply passage preferably includes a supply water passage including a supply port to supply the cooling water into the exhaust pipe and extending along a tangential direction of the inner peripheral surface of the exhaust pipe as viewed in the flow direction of the exhaust gas. Accordingly, the cooling water is supplied from the supply water passage along the tangential direction of the inner peripheral surface of the exhaust pipe, and thus the cooling water easily flows along the inner peripheral surface of the exhaust pipe. Consequently, the exhaust pipe is easily cooled by the cooling water.

In such a case, the supply water passage is preferably inclined downward toward the downstream side in the flow direction of the exhaust gas such that the supply port of the supply water passage is located below the supply water passage. Accordingly, the backflow of the cooling water toward the engine located on the upstream side in the flow direction of the exhaust gas due to a negative pressure generated in the engine is significantly reduced or prevented. Furthermore, the cooling water easily flows helically in the exhaust pipe due to the downward inclined water flow.

In a marine propulsion device including the cooling water supply passage that includes the supply water passage, the supply water passage preferably includes a plurality of supply water passages spaced apart in a circumferential direction of the exhaust pipe. Accordingly, due to the plurality of supply water passages, the cooling water contacts a larger area of the inner peripheral surface of the exhaust pipe, and thus the exhaust pipe is cooled more evenly by the cooling water.

In such a case, the cooling water supply passage preferably further includes a connecting water passage to connect the plurality of supply water passages to each other and guide the cooling water to the plurality of supply water passages. Accordingly, the cooling water is branched and introduced into the plurality of supply water passages by the connecting water passage.

A marine propulsion device including the cooling water supply passage that includes the connecting water passage preferably further includes a flange including the cooling water supply passage and attached to the exhaust pipe from above, and an exhaust guide attached to the flange from above to guide the exhaust gas to the exhaust pipe. The flange preferably includes a groove that opens upward on an upper surface of the flange, the exhaust guide preferably includes a flat surface on a lower portion of the exhaust guide that contacts the flange, and the connecting water passage is preferably defined by the groove and the flat surface. Accordingly, the cooling water supply passage is provided simply by covering the groove of the flange with the flat surface of the exhaust guide to close the groove of the flange from above, and thus the cooling water supply passage is easily provided.

In such a case, a marine propulsion device preferably further includes an oil pan to store engine oil, and the flange including the cooling water supply passage is preferably integral and unitary with the oil pan. Accordingly, as compared with a case in which the flange and the oil pan are separate from each other, the number of components is decreased, and the device structure is simplified.

In a marine propulsion device including the flange and the exhaust guide, the supply port of the supply water passage is preferably provided at a boundary between the flange and the exhaust pipe. Accordingly, the cooling water is supplied into the exhaust pipe from the most upstream position of the exhaust pipe in the flow direction of the exhaust gas, which is the boundary between the flange and the exhaust pipe. Therefore, the entire exhaust pipe is effectively cooled.

In a marine propulsion device including the flange and the exhaust guide, the groove provided on the upper surface of the flange is preferably connected to each of the plurality of supply water passages, and preferably is C-shaped or substantially C-shaped and extending along the inner peripheral surface of the exhaust pipe in a plan view. Accordingly, the cooling water is smoothly supplied to each of the plurality of supply water passages by the C-shaped or substantially C-shaped groove defining the cooling water supply passage. Furthermore, the cooling water is supplied to each of the plurality of supply water passages by the common C-shaped or substantially C-shaped groove.

In a marine propulsion device including the flange and the exhaust guide, the exhaust guide preferably includes a cooling water introduction passage to introduce the cooling water that has cooled at least one of the engine or an auxiliary into the cooling water supply passage. Accordingly, as compared with a case in which a dedicated pipe is provided to introduce the cooling water that has cooled at least one of the engine or the auxiliary into the cooling water supply passage, the number of components is decreased, and the device structure is simplified.

In a marine propulsion device including the plurality of supply water passages, the supply water passage preferably includes three or four supply water passages. Accordingly, the cooling water is supplied from an appropriate number (three or four) of supply water passages without increasing the complexity of the structure of the cooling water supply passage by providing many (five or more) supply water passages, and the cooling water contacts a larger area of the inner peripheral surface of the exhaust pipe.

A marine vessel according to a preferred embodiment of the present invention includes a hull and a marine propulsion device attached to the hull. The marine propulsion device includes an engine, an exhaust pipe to allow exhaust gas of the engine to pass through the exhaust pipe, and a cooling water supply passage to supply cooling water for the engine into the exhaust pipe toward a downstream side in a flow direction of the exhaust gas and cause the cooling water to flow circumferentially along an inner peripheral surface of the exhaust pipe.

A marine vessel according to a preferred embodiment of the present invention includes the cooling water supply passage to supply the cooling water into the exhaust pipe toward the downstream side in the flow direction of the exhaust gas and cause the cooling water to flow circumferentially along the inner peripheral surface of the exhaust pipe. Accordingly, a pressure loss with respect to the flow of the exhaust gas in the exhaust pipe occurring when the cooling water is supplied into the exhaust pipe is decreased, and the exhaust pipe is evenly cooled by the cooling water.

In a marine vessel according to a preferred embodiment of the present invention, the cooling water supply passage preferably causes the cooling water to flow helically in the exhaust pipe by causing the cooling water to flow circumferentially along the inner peripheral surface of the exhaust pipe. Accordingly, the cooling water flows helically in the exhaust pipe, and thus the cooling water flows farther along the inner peripheral surface of the exhaust pipe. Consequently, a pressure loss with respect to the flow of the exhaust gas in the exhaust pipe occurring when the cooling water is supplied into the exhaust pipe is further decreased, and the exhaust pipe is cooled more evenly by the helically flowing cooling water.

In a marine vessel according to a preferred embodiment of the present invention, the inner peripheral surface of the exhaust pipe is preferably circular or substantially circular, and the cooling water supply passage preferably includes a supply water passage including a supply port to supply the cooling water into the exhaust pipe and extending along a tangential direction of the inner peripheral surface of the exhaust pipe as viewed in the flow direction of the exhaust gas. Accordingly, the cooling water is supplied from the supply water passage along the tangential direction of the circular or substantially circular inner peripheral surface of the exhaust pipe, and thus the cooling water easily flows along the inner peripheral surface of the exhaust pipe. Consequently, the exhaust pipe is easily cooled by the cooling water.

In such a case, the supply water passage is preferably inclined downward toward the downstream side in the flow direction of the exhaust gas such that the supply port of the supply water passage is located below the supply water passage. Accordingly, the backflow of the cooling water toward the engine located on the upstream side in the flow direction of the exhaust gas due to a negative pressure generated in the engine is significantly reduced or prevented. Furthermore, the cooling water easily flows helically in the exhaust pipe due to the downward inclined water flow.

In a marine vessel including the cooling water supply passage that includes the supply water passage, the supply water passage preferably includes a plurality of supply water passages spaced apart in a circumferential direction of the exhaust pipe. Accordingly, due to the plurality of supply water passages, the cooling water contacts a larger area of the inner peripheral surface of the exhaust pipe, and thus the exhaust pipe is cooled more evenly by the cooling water.

In such a case, the cooling water supply passage preferably further includes a connecting water passage to connect the plurality of supply water passages to each other and guide the cooling water to the plurality of supply water passages. Accordingly, the cooling water is branched and introduced into the plurality of supply water passages by the connecting water passage.

In a marine vessel including the cooling water supply passage that includes the connecting water passage, the marine propulsion device preferably further includes a flange including the cooling water supply passage and attached to the exhaust pipe from above, and an exhaust guide attached to the flange from above to guide the exhaust gas to the exhaust pipe. The flange preferably includes a groove that opens upward on an upper surface of the flange, the exhaust guide preferably includes a flat surface on a lower portion of the exhaust guide that contacts the flange, and the connecting water passage is preferably defined by the groove and the flat surface. Accordingly, the cooling water supply passage is provided simply by covering the groove of the flange with the flat surface of the exhaust guide to close the groove of the flange from above, and thus the cooling water supply passage is easily provided.

In such a case, the marine propulsion device preferably further includes an oil pan to store engine oil, and the flange including the cooling water supply passage is preferably integral and unitary with the oil pan. Accordingly, as compared with a case in which the flange and the oil pan are separate from each other, the number of components is decreased, and the device structure is simplified.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including an outboard motor 101 according to preferred embodiments of the present invention is now described with reference to FIGS. 1 to 7. The outboard motor 101 is an example of a "marine propulsion device".

In the figures, arrow FWD represents the forward movement direction of the marine vessel 100 (front side with reference to a hull 100*a*), and arrow BWD represents the reverse movement direction of the marine vessel 100 (rear side with reference to the hull 100*a*).

In the figures, arrow Z represents an upward-downward direction, arrow Z1 represents the upward direction of the marine vessel 100, and arrow Z2 represents the downward direction of the marine vessel 100. The tilt angle of the outboard motor 101 is able to be changed by trimming and tilting, but each figure shows a state in which a drive shaft 30 and a crankshaft (not shown) extend in the upward-downward direction. The downward direction indicated by arrow Z2 is an example of a "flow direction of the exhaust gas".

Figure 1:
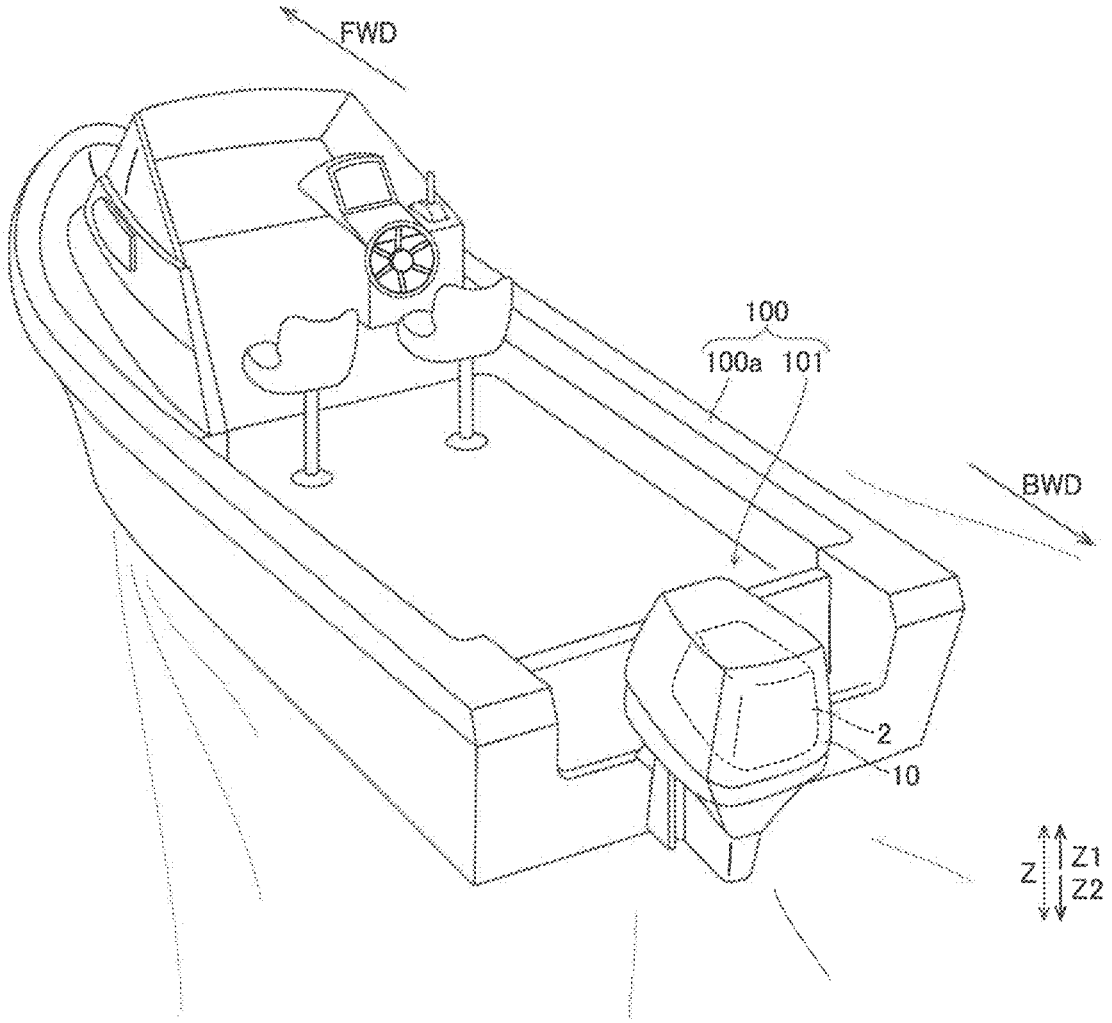
FIG. 1 is a perspective view showing a marine vessel including an outboard motor according to a preferred embodiment of the present invention.

As shown in FIG. 1, the marine vessel 100 includes the hull 100*a* and the outboard motor 101. The outboard motor 101 is attached to the transom of the hull 100*a*. That is, the marine vessel 100 is an outboard motor boat.

Figure 2:
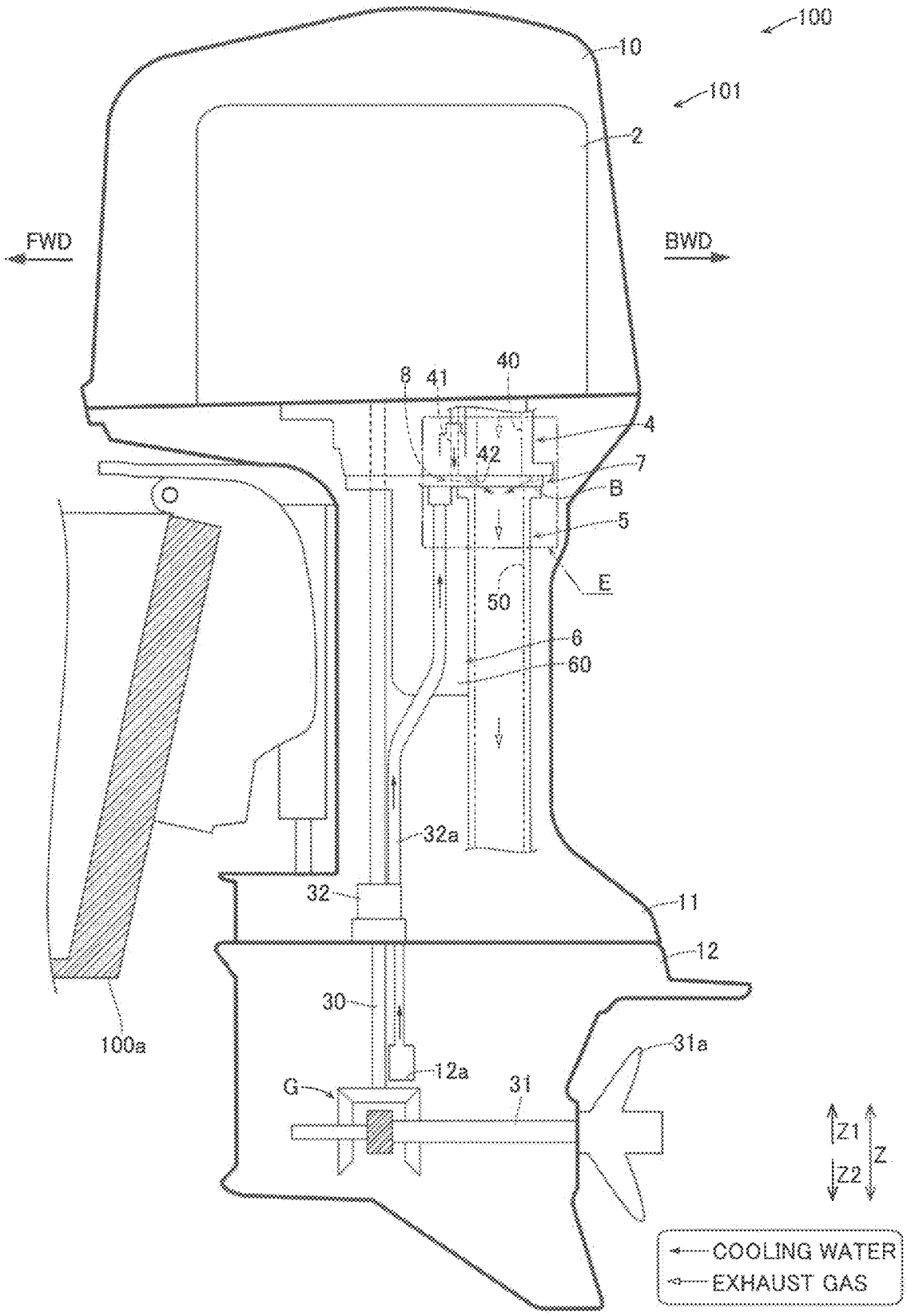
FIG. 2 is a side view showing an outboard motor according to a preferred embodiment of the present invention.

The outboard motor 101 according to a preferred embodiment of the present invention shown in FIG. 2 is an engine-driven outboard motor. The outboard motor 101 pumps external water (seawater, lake water, etc.) as cooling water for the engine 2 with a water pump 32, cools the engine 2, and then supplies a portion of the cooling water into an exhaust pipe 5.

Thus, the outboard motor 101 cools the exhaust pipe 5 and exhaust gas flowing through the exhaust pipe 5. The details are described below. The outboard motor 101 allows the cooling water that has cooled the engine 2 to flow downward (in a Z1 direction) along the axial direction (a direction in which the drive shaft 30 extends) of the crankshaft.

As shown in FIG. 2, the outboard motor 101 includes a cowling 10, an upper case 11, and a lower case 12. In FIG. 2, for the purpose of clarifying the structure, the internal structures of the cowling 10, the upper case 11, and the lower case 12 are shown by solid lines instead of broken lines.

The outboard motor 101 includes the engine 2, the drive shaft 30, a propeller shaft 31, a propeller 31*a*, the water pump 32, an exhaust guide 4, and the exhaust pipe 5.

The outboard motor 101 also includes an oil pan 6, a flange 7, and a cooling water supply passage 8. The cooling water supply passage 8 is provided in the flange 7. The flange 7 in which the cooling water supply passage 8 is provided is integral and unitary with the oil pan 6.

The cowling 10 is provided on an upper portion of the outboard motor 101. Inside the cowling 10, the engine 2 and an engine control unit (not shown) to control driving of the outboard motor 101 are housed.

The lower case 12 is provided on a lower portion of the outboard motor 101. The upper case 11 is provided between the cowling 10 and the lower case 12. The lower case 12 includes a water inlet 12*a* to take in cooling water from the outside of the outboard motor 101.

As shown in FIG. 2, the engine 2 is an internal combustion engine that generates a driving force by explosively burning fuel mixed with air and rotating the crankshaft (not shown), and is cooled by cooling water and engine oil.

A first end of the drive shaft 30 is connected to the crankshaft, and a driving force is transmitted from the crankshaft to the drive shaft 30 to rotate the drive shaft 30. A second end of the drive shaft 30 extends into the lower case 12. The water pump 32 is attached to the drive shaft 30.

The propeller shaft 31 is connected to the drive shaft 30 via a gear unit G, and a driving force is transmitted from the drive shaft 30 to the propeller shaft 31 to rotate the propeller shaft 31. The propeller shaft 31 extends in a direction perpendicular to the drive shaft 30. In FIG. 2, the propeller shaft 31 extends in a forward-rearward direction.

The propeller 31*a* is attached to the rear end of the propeller shaft 31, and rotates together with the propeller shaft 31 to generate a propulsive force.

The water pump 32 is attached to the drive shaft 30 and includes an impeller rotated by the drive shaft 30. A pump chamber in which the impeller of the water pump 32 is provided communicates with the water inlet 12*a*. The water pump 32 pumps cooling water from the water inlet 12*a* toward the engine 2 by rotation.

A water supply pipe 32*a* extending toward the cowling 10 in which the engine 2 is located is connected to the water pump 32 from above. The water pump 32 delivers the cooling water pumped through the water supply pipe 32*a* toward the engine 2. That is, the water pump 32 is a lifting pump.

Figure 3:
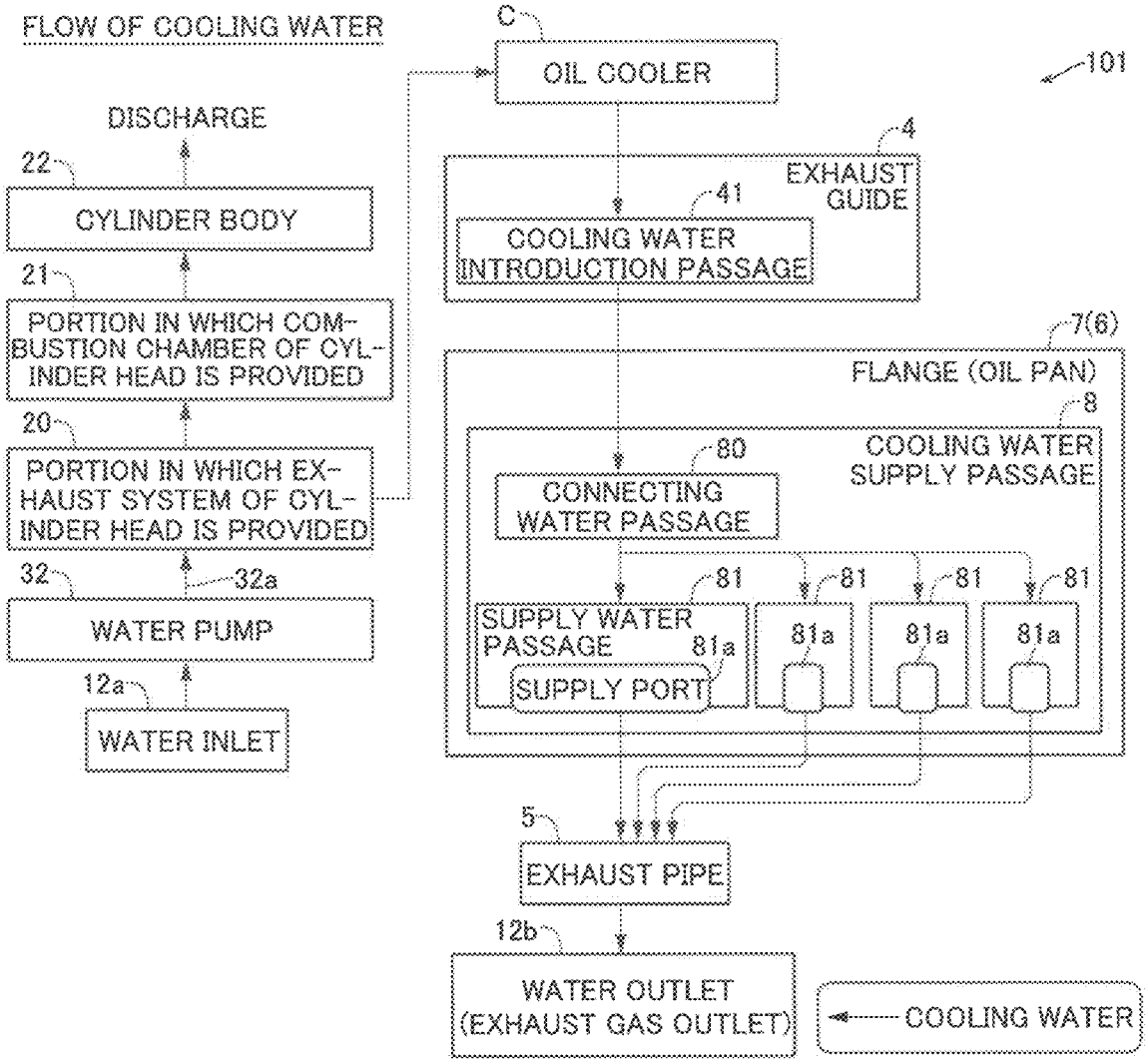
FIG. 3 is a block diagram illustrating the flow of cooling water inside an outboard motor.

The flow of cooling water in the outboard motor 101 is now described with reference to FIG. 3. First, the cooling water is pumped from the water inlet 12*a* by the water pump 32 and is delivered to the water supply pipe 32*a*. Then, the cooling water in the water supply pipe 32*a* passes through the exhaust guide 4 and is supplied to a portion 20 of the engine 2 in which an exhaust system of a cylinder head is provided.

Then, the cooling water is branched in two directions, i.e., to a portion 21 of the engine 2 in which a combustion chamber of the cylinder head is provided and to an oil cooler C. The oil cooler C is an example of an "auxiliary".

Then, the cooling water that has flowed to the portion 21 of the engine 2 in which the combustion chamber of the cylinder head is provided is supplied to a cylinder body 22 of the engine 2 and then discharged to the outside of the outboard motor 101 (see FIG. 1). Furthermore, the cooling water that has flowed to the oil cooler C flows, in order, through a cooling water introduction passage 41 provided in the exhaust guide 4 and the cooling water supply passage 8 (a connecting water passage 80 and supply water passages 81) provided in the flange 7 and is supplied into the exhaust pipe 5. The cooling water supplied into the exhaust pipe 5 is discharged together with the exhaust gas from a water outlet 12*b* into the water outside the outboard motor 101.

The exhaust guide 4 and the exhaust pipe 5 shown in FIG. 2 guide the flow of the exhaust gas discharged from the engine 2. The exhaust guide 4 and the exhaust pipe 5 are located in this order from the upstream side to the downstream side in the flow direction of the exhaust gas.

The engine 2 is directly attached to the exhaust guide 4 from above. Furthermore, the flange 7 (oil pan 6) is directly attached to the exhaust guide 4 from below.

Figure 4:
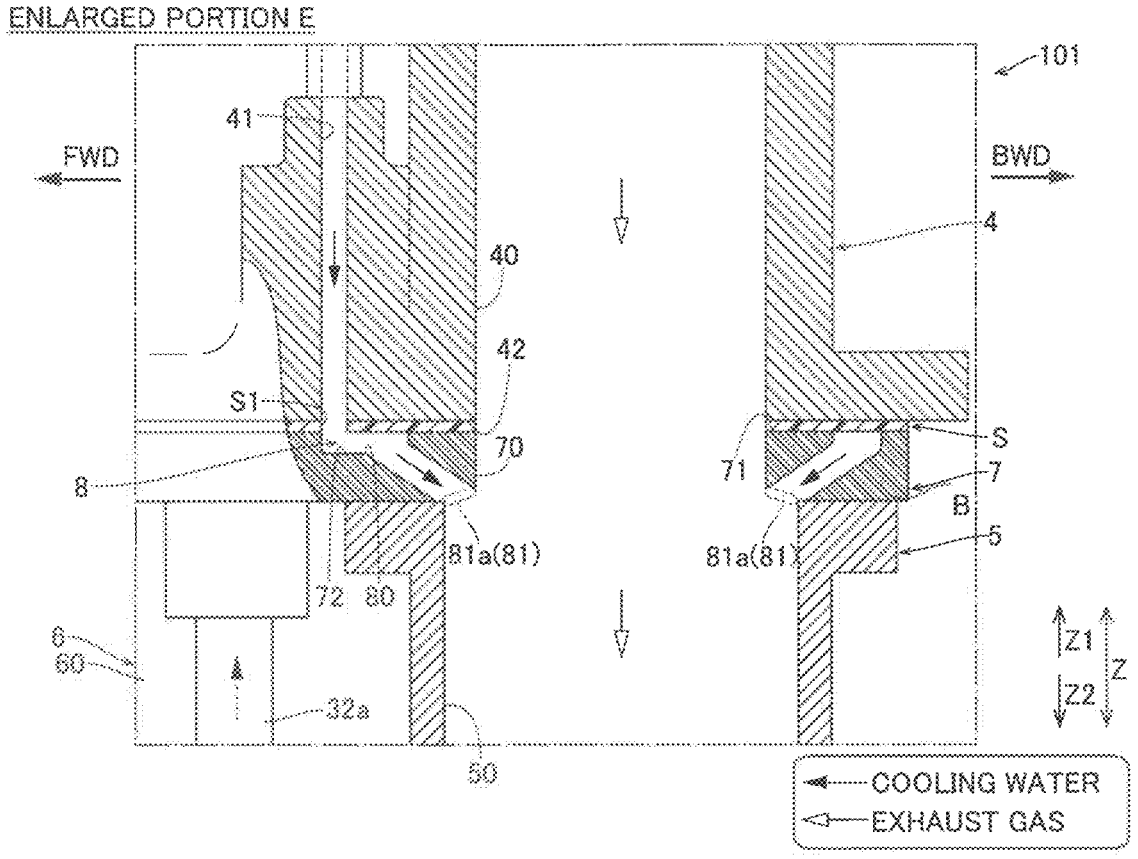
FIG. 4 is an enlarged view of a portion E in FIG. 2.

As shown in FIG. 4, the exhaust guide 4 includes an exhaust gas passage 40, the cooling water introduction passage 41, and a flat surface 42.

The exhaust gas passage 40 is defined by a through-hole that passes through the exhaust guide 4 in the upward-downward direction. The exhaust guide 4 guides the exhaust gas to the exhaust pipe 5 via the exhaust gas passage 40. The exhaust gas passage 40 extends in a direction along the drive shaft 30 (crankshaft) (see FIG. 2).

The cooling water introduction passage 41 is defined by a through-hole that passes through the exhaust guide 4 in the upward-downward direction. The cooling water introduction passage 41 introduces the cooling water that has cooled the engine 2 (see FIG. 2) into the cooling water supply passage 8.

A seal S is provided between the exhaust guide 4 and the flange 7. The seal S includes a cooling water passing hole S1 to allow cooling water to pass therethrough and be supplied from the cooling water introduction passage 41 of the exhaust guide 4 to the cooling water supply passage 8 of the flange 7.

The flat surface 42 is provided on a lower portion of the exhaust guide 4 that contacts the flange 7. That is, the flat surface 42 contacts the upper surface 71 of the flange 7. The flat surface 42 of the exhaust guide 4 contacts the flange 7 from above to close (cover) a groove 72 described below that is provided in the flange 7 and through which the cooling water passes.

Thus, the exhaust guide 4 prevents the cooling water from leaking from a boundary between the flat surface 42 and the flange 7. The groove 72 defines the connecting water passage 80 described below, which is a portion of the cooling water supply passage 8. The details are described below.

The exhaust pipe 5 is directly attached to the flange 7 from below. Therefore, the exhaust pipe 5 and the exhaust guide 4 sandwich the flange 7 in the upward-downward direction. The exhaust pipe 5 extends substantially in the upward-downward direction. That is, the exhaust pipe 5 extends in the direction along the drive shaft 30 (crankshaft). The exhaust pipe 5 allows the exhaust gas of the engine 2 to pass therethrough. The exhaust pipe 5 allows the exhaust gas to flow to the rear of the lower case 12 and to be discharged into the water outside the outboard motor 101.

The exhaust pipe 5 includes a circular or substantially circular inner peripheral surface 50 (hereinafter "circular"). The exhaust pipe 5 is cooled by the cooling water supplied from the cooling water supply passage 8 into the exhaust pipe 5.

The oil pan 6 shown in FIG. 2 stores engine oil having functions of cooling, lubricating, and cleaning the engine 2, for example. The engine oil stored in the oil pan 6 is pumped by an oil pump (not shown) and circulated in the engine 2.

The oil pan 6 is defined by a portion 60 that stores engine oil and the flange 7 that protrudes in a horizontal direction (a direction intersecting with the direction in which the drive shaft 30 extends) from the upper end of the portion 60 that stores the engine oil.

As shown in FIG. 4, the flange 7 includes a through-hole 70 to guide the exhaust gas from the exhaust gas passage 40 of the exhaust guide 4 to the exhaust pipe 5. Furthermore, the flange 7 includes the cooling water supply passage 8 located around the through-hole 70 in a plan view.

The flange 7 includes the groove 72 that opens upward on the upper surface 71 of the flange 7. The groove 72 (the connecting water passage 80 described below) provided on the upper surface 71 of the flange 7 is C-shaped or substantially C-shaped (hereinafter "C-shaped") extending along the inner peripheral surface 50 (through-hole 70) of the exhaust pipe 5 in the plan view (see FIG. 5).

The flange 7 includes a low rotation exhaust passage L (see FIG. 5) to exhaust the exhaust gas when the engine 2 rotates at a low speed such as at the time of idling. The outboard motor 101 supplies the cooling water into the exhaust pipe 5 downstream of the low rotation exhaust passage L in the flow direction of the exhaust gas.

Figure 5:
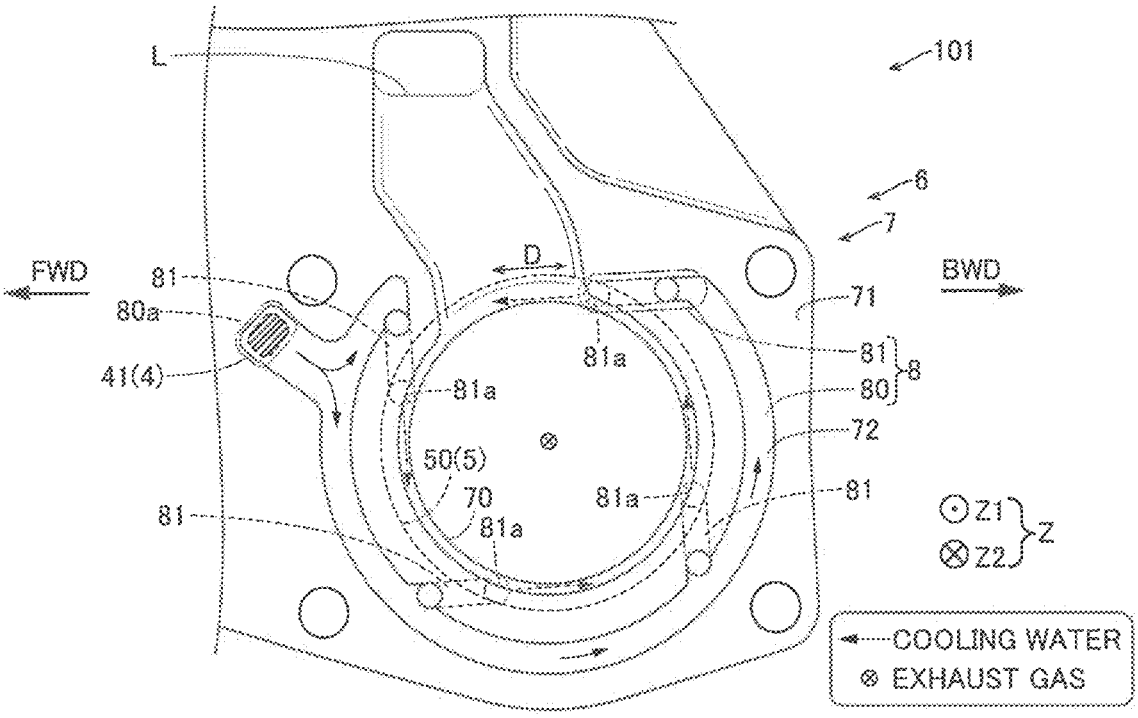
FIG. 5 is a plan view of a flange and a cooling water supply passage of an outboard motor according to a preferred embodiment of the present invention.
Figure 6:
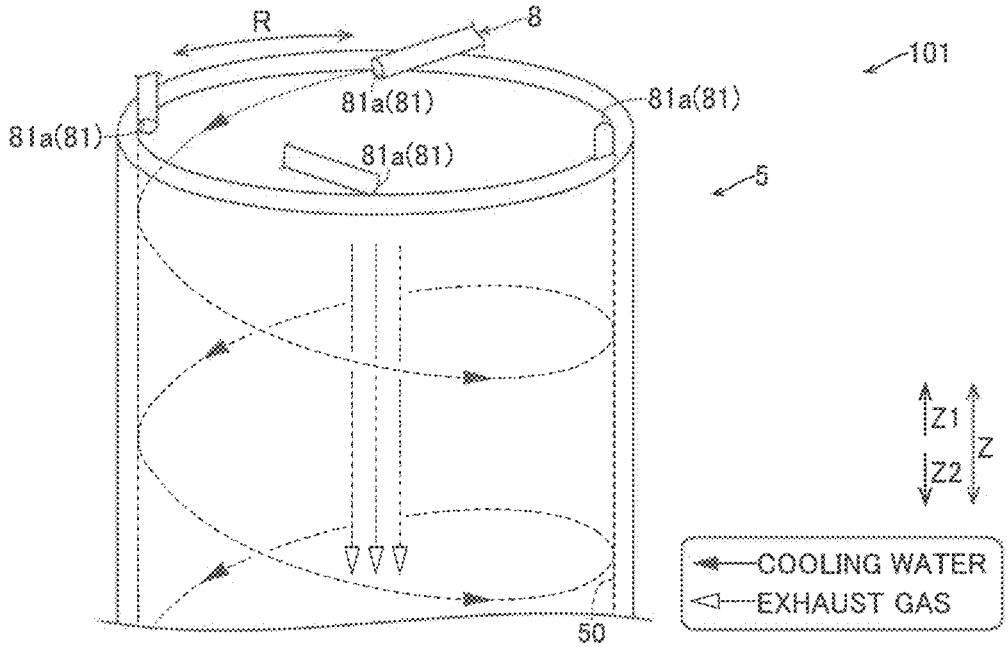
FIG. 6 is a schematic view illustrating the flow of cooling water and the flow of exhaust gas in an exhaust pipe.

As shown in FIGS. 5 and 6, the cooling water supply passage 8 supplies cooling water for the engine 2 into the exhaust pipe 5 toward the downstream side (lower side) in the flow direction of the exhaust gas, and causes the cooling water to flow circumferentially along the inner peripheral surface 50 of the exhaust pipe 5. Consequently, the cooling water supply passage 8 causes the cooling water to flow helically in the exhaust pipe 5 by causing the cooling water to flow circumferentially along the inner peripheral surface 50 of the exhaust pipe 5.

The cooling water supply passage 8 causes the cooling water to flow helically in the exhaust pipe 5 such that as compared with a case in which the cooling water is supplied linearly directly downward in the exhaust pipe 5, the cooling water contacts a larger area of the inner peripheral surface 50 of the exhaust pipe 5.

The cooling water supply passage 8 includes the connecting water passage 80 and a plurality of supply water passages 81. The cooling water flows through the connecting water passage 80 and the plurality of supply water passages 81 in this order. In FIG. 5, a portion 80*a* of the connecting water passage 80 to which the cooling water is first supplied is hatched.

Figure 7:
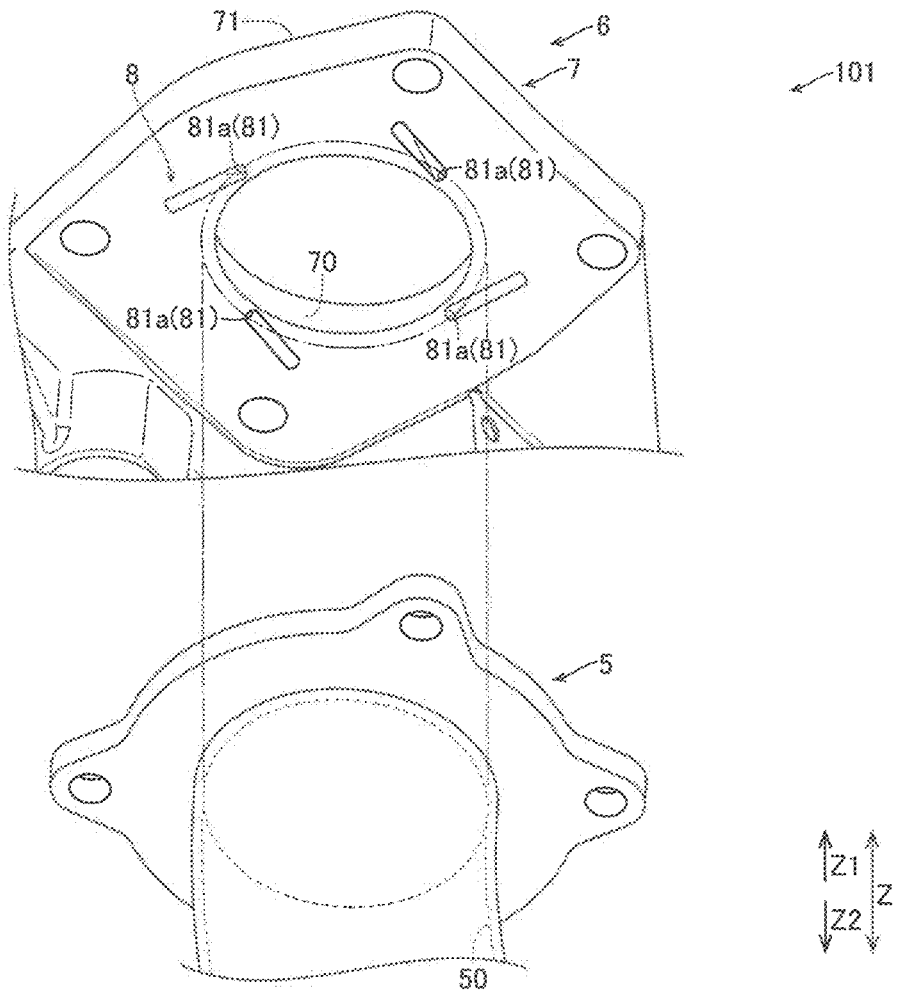
FIG. 7 is a perspective view showing a flange, a cooling water supply passage, and an exhaust pipe of an outboard motor according to a preferred embodiment of the present invention as viewed from below.

An end of the connecting water passage 80 shown in FIGS. 5 to 7 on the upstream side in the flow direction of the cooling water communicates with the cooling water introduction passage 41 of the exhaust guide 4, and the cooling water is introduced from the cooling water introduction passage 41 into the connecting water passage 80. The supply water passages 81 are defined by the groove 72 of the flange 7 and the flat surface 42 of the exhaust guide 4.

The connecting water passage 80 connects the plurality of supply water passages 81 to each other. Furthermore, the connecting water passage 80 guides the cooling water to the plurality of supply water passages 81.

Specifically, an end of the connecting water passage 80 on the downstream side in the flow direction of the cooling water is connected to the plurality of supply water passages 81. The connecting water passage 80 divides the cooling water from the cooling water introduction passage 41 of the exhaust guide 4 into a plurality of branches and guides the cooling water to the supply water passages 81. The connecting water passage 80 is C-shaped or substantially C-shaped (hereinafter "C-shaped") and extends along the inner peripheral surface 50 (through-hole 70) of the exhaust pipe 5 in the plan view.

Four supply water passages 81 are provided, for example. The plurality of (four) supply water passages 81 are spaced apart in the circumferential direction (R direction; see FIG. 6) of the exhaust pipe 5. The plurality of supply water passages 81 are provided at equal or substantially equal angular intervals in the circumferential direction (R direction) of the exhaust pipe 5. The plurality of supply water passages 81 are provided on the inner peripheral side of the C-shaped connecting water passage 80 in the plan view. Ends of the supply water passages 81 on the upstream side in the flow direction of the cooling water are connected to the connecting water passage 80.

The supply water passages 81 each include a supply port 81*a* to supply the cooling water into the exhaust pipe 5. The supply port 81*a* is provided at an end of each of the supply water passages 81 on the downstream side in the flow direction of the cooling water. The supply port 81*a* is provided at a boundary B (see FIG. 4) between the flange 7 and the exhaust pipe 5. The supply water passages 81 extend linearly or substantially linearly.

The plurality of supply water passages 81 supply the cooling water in the same direction (counterclockwise in the plan view) in the circumferential direction (R direction) of the inner peripheral surface 50 of the exhaust pipe 5 in order to significantly reduce or prevent collision of the cooling water supplied into the exhaust pipe 5 from the supply port 81*a* with each other.

The supply water passages 81 extend along the tangential direction D (FIG. 5 shows the tangential direction with respect only to the supply water passage 81 surrounded by a one-dot chain line) of the inner peripheral surface 50 of the exhaust pipe 5. Therefore, the cooling water supplied from the supply water passages 81 into the exhaust pipe 5 flows toward the downstream side in the flow direction of the exhaust gas while being swirled along the inner peripheral surface 50. When the supply water passages extend in the radial direction of the inner peripheral surface of the exhaust pipe, the cooling water supplied into the exhaust pipe goes to a central portion of the exhaust pipe, and thus the cooling water collides with the exhaust gas in the central portion of the exhaust pipe and obstructs the flow of the exhaust gas. In such a case, the outboard motor increases a pressure loss with respect to the flow of the exhaust gas in the exhaust pipe (in an exhaust path). In this regard, the supply water passages 81 according to preferred embodiments of the present invention supply the cooling water into the exhaust pipe 5 such that the exhaust gas passes through an inner peripheral side of the cooling water supplied into the exhaust pipe 5.

The supply water passages 81 are inclined downward toward the downstream side in the flow direction of the exhaust gas such that the supply port 81*a* of each of the supply water passages 81 is located below the supply water passages 81. As an example, the supply water passages 81 are inclined downward toward the downstream side in the flow direction of the exhaust gas at an inclination angle of about 30 degrees, for example.

According to the various preferred embodiments of the present invention described above, the following advantageous effects are achieved.

According to a preferred embodiment of the present invention, the outboard motor 101 includes the cooling water supply passage 8 to supply the cooling water into the exhaust pipe 5 toward the downstream side in the flow direction of the exhaust gas and cause the cooling water to flow circumferentially along the inner peripheral surface 50 of the exhaust pipe 5. Accordingly, the cooling water flows along the inner peripheral surface 50 of the exhaust pipe 5 away from the central portion of the exhaust pipe 5, and thus obstruction of the main flow of the exhaust gas passing through the central portion of the exhaust pipe 5 by the cooling water is significantly reduced or prevented. Therefore, a pressure loss with respect to the flow of the exhaust gas in the exhaust pipe 5 occurring when the cooling water is supplied into the exhaust pipe 5 is decreased. Furthermore, the cooling water flows circumferentially along the inner peripheral surface 50 of the exhaust pipe 5 such that as compared with a case in which the cooling water is supplied linearly toward the downstream side in the flow direction of the exhaust gas, the cooling water contacts a larger area of the inner peripheral surface 50 of the exhaust pipe 5. Therefore, the exhaust pipe 5 is evenly cooled by the cooling water. Thus, a pressure loss with respect to the flow of the exhaust gas in the exhaust pipe 5 occurring when the cooling water is supplied into the exhaust pipe 5 is decreased, and the exhaust pipe 5 is evenly cooled by the cooling water.

According to a preferred embodiment of the present invention, the cooling water supply passage 8 causes the cooling water to flow helically in the exhaust pipe 5 by causing the cooling water to flow circumferentially along the inner peripheral surface 50 of the exhaust pipe 5. Accordingly, the cooling water flows helically in the exhaust pipe 5, and thus the cooling water flows farther along the inner peripheral surface 50 of the exhaust pipe 5. Consequently, a pressure loss with respect to the flow of the exhaust gas in the exhaust pipe 5 occurring when the cooling water is supplied into the exhaust pipe 5 is further decreased, and the exhaust pipe 5 is cooled more evenly by the helically flowing cooling water.

According to a preferred embodiment of the present invention, the cooling water supply passage 8 includes the supply water passages 81 each including the supply port 81*a* to supply the cooling water into the exhaust pipe 5 and extending along the tangential direction D of the inner peripheral surface 50 of the exhaust pipe 5 as viewed in the flow direction of the exhaust gas. Accordingly, the cooling water is supplied from the supply water passages 81 along the tangential direction D of the inner peripheral surface 50 of the exhaust pipe 5, and thus the cooling water easily flows along the inner peripheral surface 50 of the exhaust pipe 5. Consequently, the exhaust pipe 5 is easily cooled by the cooling water.

According to a preferred embodiment of the present invention, the supply water passages 81 are inclined downward toward the downstream side in the flow direction of the exhaust gas such that the supply port 81*a* of each of the supply water passages 81 is located below the supply water passages 81. Accordingly, the backflow of the cooling water toward the engine 2 located on the upstream side in the flow direction of the exhaust gas due to a negative pressure generated in the engine 2 is significantly reduced or prevented. Furthermore, the cooling water easily flows helically in the exhaust pipe 5 due to the downward inclined water flow.

According to a preferred embodiment of the present invention, the plurality of supply water passages 81 are spaced apart in the circumferential direction of the exhaust pipe 5. Accordingly, due to the plurality of supply water passages 81, the cooling water contacts a larger area of the inner peripheral surface 50 of the exhaust pipe 5, and thus the exhaust pipe 5 is cooled more evenly by the cooling water.

According to a preferred embodiment of the present invention, the cooling water supply passage 8 further includes the connecting water passage 80 to connect the plurality of supply water passages 81 to each other and guide the cooling water to the plurality of supply water passages 81. Accordingly, the cooling water is branched and introduced into the plurality of supply water passages 81 by the connecting water passage 80.

According to a preferred embodiment of the present invention, the outboard motor 101 further includes the flange 7 including the cooling water supply passage 8 and is attached to the exhaust pipe 5 from above, and the exhaust guide 4 is attached to the flange 7 from above to guide the exhaust gas to the exhaust pipe 5. Furthermore, the flange 7 includes the groove 72 that opens upward on the upper surface 71 of the flange 7, the exhaust guide 4 includes the flat surface 42 on the lower portion of the exhaust guide 4 that contacts the flange 7, and the connecting water passage 80 is defined by the groove 72 and the flat surface 42. Accordingly, the cooling water supply passage 8 is provided simply by covering the groove 72 of the flange 7 with the flat surface 42 of the exhaust guide 4 to close the groove 72 of the flange 7 from above, and thus the cooling water supply passage 8 is easily provided.

According to a preferred embodiment of the present invention, the outboard motor 101 further includes the oil pan 6 to store the engine oil, and the flange 7 including the cooling water supply passage 8 is integral and unitary with the oil pan 6. Accordingly, as compared with a case in which the flange 7 and the oil pan 6 are separate from each other, the number of components is decreased, and the device structure is simplified.

According to a preferred embodiment of the present invention, the supply port 81*a* of each of the supply water passages 81 is provided at the boundary B between the flange 7 and the exhaust pipe 5. Accordingly, the cooling water is supplied into the exhaust pipe 5 from the most upstream position of the exhaust pipe 5 in the flow direction of the exhaust gas, which is the boundary B between the flange 7 and the exhaust pipe 5. Therefore, the entire exhaust pipe 5 is effectively cooled.

According to a preferred embodiment of the present invention, the groove 72 provided on the upper surface 71 of the flange 7 is connected to each of the plurality of supply water passages 81, and is C-shaped and extends along the inner peripheral surface 50 of the exhaust pipe 5 in the plan view. Accordingly, the cooling water is smoothly supplied to each of the plurality of supply water passages 81 by the C-shaped groove 72 defining the cooling water supply passage 8. Furthermore, the cooling water is supplied to each of the plurality of supply water passages 81 by the common C-shaped groove 72.

According to a preferred embodiment of the present invention, the exhaust guide 4 includes the cooling water introduction passage 41 to introduce the cooling water that has cooled the engine 2 and the oil cooler C into the cooling water supply passage 8. Accordingly, as compared with a case in which a dedicated pipe is provided to introduce the cooling water that has cooled the engine 2 and the oil cooler C into the cooling water supply passage 8, the number of components is decreased, and the device structure is simplified.

According to a preferred embodiment of the present invention, four of the supply water passages 81 are preferably provided. Accordingly, the cooling water is supplied from an appropriate number of supply water passages 81 without increasing the complexity of the structure of the cooling water supply passage 8 by providing many (e.g., five or more) supply water passages 81, and the cooling water contacts a larger area of the inner peripheral surface 50 of the exhaust pipe 5.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the marine vessel is preferably an outboard motor boat in preferred embodiments described above, the present invention is not restricted to this. That is, the marine vessel may alternatively be a marine vessel other than an outboard motor boat. For example, the marine vessel may be a marine vessel including an inboard motor, an inboard-outboard motor, or a jet propulsion device.

While four supply water passages are preferably provided in preferred embodiments described above, the present invention is not restricted to this. In a preferred embodiment of the present invention, one, two, three, or five or more supply water passages may alternatively be provided. For example, from the viewpoint of evenly cooling the exhaust pipe with an appropriate number of supply water passages, it is particularly preferable to provide three or four supply water passages.

While the marine vessel preferably includes one outboard motor (marine propulsion device) in preferred embodiments described above, the present invention is not restricted to this. In a preferred embodiment of the present invention, the marine vessel may alternatively include a plurality of marine propulsion devices.

While the cooling water supply passage is preferably provided in the flange in preferred embodiments described above, the present invention is not restricted to this. In a preferred embodiment of the present invention, the cooling water supply passage may alternatively be provided in a structure different from the flange such as a dedicated pipe or the exhaust guide. When the flange is not provided, the exhaust guide and the exhaust pipe may directly contact each other.

While the flange is preferably integral and unitary with the oil pan in preferred embodiments described above, the present invention is not restricted to this. In a preferred embodiment of the present invention, the flange and the oil pan may alternatively be separate from each other.

While the cooling water is preferably supplied into the exhaust pipe from the boundary between the flange and the exhaust pipe in preferred embodiments described above, the present invention is not restricted to this. In a preferred embodiment of the present invention, the cooling water may alternatively be supplied into the exhaust pipe from a position between an exhaust gas inlet and an exhaust gas outlet of the exhaust pipe, for example.

While the connecting water passage is preferably provided on the upper surface side of the flange in preferred embodiments described above, the present invention is not restricted to this. In a preferred embodiment of the present invention, the connecting water passage may alternatively be provided on the lower surface side of the flange.

While the connecting water passage preferably is C-shaped in preferred embodiments described above, the present invention is not restricted to this. In a preferred embodiment of the present invention, the connecting water passage may alternatively have a shape different from the C shape such as a circular shape or an L shape.

While the outboard motor (marine propulsion device) preferably includes the oil pan in preferred embodiments described above, the present invention is not restricted to this. In a preferred embodiment of the present invention, the marine propulsion device may not include the oil pan.

While the cooling water is preferably introduced into the cooling water supply passage of the flange via the exhaust guide in preferred embodiments described above, the present invention is not restricted to this. In a preferred embodiment of the present invention, the cooling water may alternatively be introduced into the cooling water supply passage of the flange via a dedicated pipe or the like instead of the exhaust guide.

While the cooling water that has cooled both the engine and the oil cooler (auxiliary) is preferably supplied into the exhaust pipe in preferred embodiments described above, the present invention is not restricted to this. In a preferred embodiment of the present invention, the cooling water that has cooled only one of the engine and the auxiliary may alternatively be supplied into the exhaust pipe. Alternatively, a portion of the cooling water may be branched before being pumped by the water pump and reaching the engine, and the branched cooling water may be supplied into the exhaust pipe.

While the auxiliary is preferably an oil cooler in preferred embodiments described above, the present invention is not restricted to this. In a preferred embodiment of the present invention, the auxiliary may alternatively be a structure other than the oil cooler.

While a plurality of supply water passages are preferably provided at equal or substantially equal angular intervals in the circumferential direction of the exhaust pipe in preferred embodiments described above, the present invention is not restricted to this. In a preferred embodiment of the present invention, a plurality of supply water passages may not be provided at equal or substantially equal angular intervals in the circumferential direction of the exhaust pipe. For example, in order to effectively cool a portion of the inner peripheral surface of the exhaust pipe that tends to be particularly hot, a plurality of supply water passages may be concentrated in that portion.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine;

an exhaust pipe to allow exhaust gas of the engine to pass through the exhaust pipe; and a cooling water supply passage to supply cooling water for the engine into the exhaust pipe toward a downstream side in a flow direction of the exhaust gas and cause the cooling water to flow circumferentially along an inner peripheral surface of the exhaust pipe.

2. The marine propulsion device according to claim 1, wherein the cooling water supply passage causes the cooling water to flow helically in the exhaust pipe by causing the cooling water to flow circumferentially along the inner peripheral surface of the exhaust pipe.

3. The marine propulsion device according to claim 1, wherein the inner peripheral surface of the exhaust pipe is circular or substantially circular; and the cooling water supply passage includes a supply water passage including a supply port to supply the cooling water into the exhaust pipe and extending along a tangential direction of the inner peripheral surface of the exhaust pipe as viewed in the flow direction of the exhaust gas.

4. The marine propulsion device according to claim 3, wherein the supply water passage is inclined downward toward the downstream side in the flow direction of the exhaust gas such that the supply port of the supply water passage is located below the supply water passage.

5. The marine propulsion device according to claim 3, wherein the supply water passage includes a plurality of supply water passages spaced apart in a circumferential direction of the exhaust pipe.

6. The marine propulsion device according to claim 5, wherein the cooling water supply passage further includes a connecting water passage to connect the plurality of supply water passages to each other and guide the cooling water to the plurality of supply water passages.

7. The marine propulsion device according to claim 6, further comprising:

a flange including the cooling water supply passage and attached to the exhaust pipe from above; and an exhaust guide attached to the flange from above to guide the exhaust gas to the exhaust pipe; wherein the flange includes a groove that opens upward on an upper surface of the flange;

the exhaust guide includes a flat surface on a lower portion of the exhaust guide that contacts the flange; and the connecting water passage is defined by the groove and the flat surface.

8. The marine propulsion device according to claim 7, further comprising:

an oil pan to store engine oil; wherein the flange including the cooling water supply passage is integral and unitary with the oil pan.

9. The marine propulsion device according to claim 7, wherein the supply port of the supply water passage is provided at a boundary between the flange and the exhaust pipe.

10. The marine propulsion device according to claim 7, wherein the groove provided on the upper surface of the flange is connected to each of the plurality of supply water passages, and is C-shaped or substantially C-shaped and extends along the inner peripheral surface of the exhaust pipe in a plan view.

11. The marine propulsion device according to claim 7, wherein the exhaust guide includes a cooling water introduction passage to introduce the cooling water that has cooled at least one of the engine or an auxiliary into the cooling water supply passage.

12. The marine propulsion device according to claim 5, wherein the supply water passage includes three or four supply water passages.

13. A marine vessel comprising:

a hull; and a marine propulsion device attached to the hull; wherein the marine propulsion device includes:

an engine;

an exhaust pipe to allow exhaust gas of the engine to pass through the exhaust pipe; and a cooling water supply passage to supply cooling water for the engine into the exhaust pipe toward a downstream side in a flow direction of the exhaust gas and cause the cooling water to flow circumferentially along an inner peripheral surface of the exhaust pipe.

14. The marine vessel according to claim 13, wherein the cooling water supply passage causes the cooling water to flow helically in the exhaust pipe by causing the cooling water to flow circumferentially along the inner peripheral surface of the exhaust pipe.

15. The marine vessel according to claim 13, wherein the inner peripheral surface of the exhaust pipe is circular or substantially circular; and the cooling water supply passage includes a supply water passage including a supply port to supply the cooling water into the exhaust pipe and extending along a tangential direction of the inner peripheral surface of the exhaust pipe as viewed in the flow direction of the exhaust gas.

16. The marine vessel according to claim 15, wherein the supply water passage is inclined downward toward the downstream side in the flow direction of the exhaust gas such that the supply port of the supply water passage is located below the supply water passage.

17. The marine vessel according to claim 15, wherein the supply water passage includes a plurality of supply water passages spaced apart in a circumferential direction of the exhaust pipe.

18. The marine vessel according to claim 17, wherein the cooling water supply passage further includes a connecting water passage to connect the plurality of supply water passages to each other and guide the cooling water to the plurality of supply water passages.

19. The marine vessel according to claim 18, wherein the marine propulsion device further includes:

a flange including the cooling water supply passage and attached to the exhaust pipe from above; and an exhaust guide attached to the flange from above to guide the exhaust gas to the exhaust pipe;

the flange includes a groove that opens upward on an upper surface of the flange;

the exhaust guide includes a flat surface on a lower portion of the exhaust guide that contacts the flange; and the connecting water passage is defined by the groove and the flat surface.

20. The marine vessel according to claim 19, wherein the marine propulsion device further includes an oil pan to store engine oil; and the flange including the cooling water supply passage is integral and unitary with the oil pan.

* * * * *